US012768063B2

(12) United States Patent
Yakuma et al.

(10) Patent No.: US 12,768,063 B2
(45) Date of Patent: Oct. 20, 2026

(54) ELECTROLYTIC SOLUTION, MAGNESIUM PRODUCTION METHOD, MAGNESIUM, AND MAGNESIUM FOIL

(71) Applicants: NIPPON LIGHT METAL COMPANY, LTD., Tokyo (JP); MURATA MANUFACTURING CO., LTD., Kyoto (JP)

(72) Inventors: Hajime Yakuma, Shizuoka (JP); Satoshi Kobayashi, Shizuoka (JP); Yuri Nakayama, Kyoto (JP)

(73) Assignees: NIPPON LIGHT METAL COMPANY, LTD.; MURATA MANUFACTURING CO., LTD.

( * ) Notice: Subject to any disclaimer, the term of this patent is extended or adjusted under 35 U.S.C. 154(b) by 0 days.

(21) Appl. No.: 17/925,948

(22) PCT Filed: Feb. 22, 2021

(86) PCT No.: PCT/JP2021/006605
§ 371 (c)(1),
(2) Date: Nov. 17, 2022

(87) PCT Pub. No.: WO2021/235034
PCT Pub. Date: Nov. 25, 2021

(65) Prior Publication Data

US 2023/0183877 A1 Jun. 15, 2023

(30) Foreign Application Priority Data

May 20, 2020 (JP) ..... 2020-087831

(51) Int. Cl.
*C25D 3/42* (2006.01)
*C25D 21/12* (2006.01)

(52) U.S. Cl.
CPC ..... *C25D 3/42* (2013.01); *C25D 21/12* (2013.01)

(58) Field of Classification Search
CPC ..... C25D 3/54; C25D 3/56; C25D 3/42
(Continued)

(56) References Cited

U.S. PATENT DOCUMENTS

2012/0107698 A1 5/2012 Muldoon et al.
2014/0170507 A1* 6/2014 Matsui ..... H01M 6/162 429/337
2016/0028117 A1 1/2016 Oh et al.

FOREIGN PATENT DOCUMENTS

CN 106384844 A 2/2017
CN 106532111 A 3/2017
(Continued)

OTHER PUBLICATIONS

Wang et al., "Electrochemical Deposition of Magnesium from Analogous Ionic Liquid Based on Dimethylformamide," Electrochimica Acta (Oct. 1, 2013), vol. 108, pp. 384-389. (Year: 2013).*
(Continued)

*Primary Examiner* — Edna Wong

(57) ABSTRACT

This electrolytic solution contains magnesium chloride, lithium chloride, and an aprotic solvent. In the electrolytic solution, the concentration at which the total of magnesium chloride and lithium chloride are dissolved with respect to 1 mol of an aprotic solvent is 0.09 mol or more. In addition, in the electrolytic solution, the concentration at which magnesium chloride is dissolved with respect to 1 mol of the aprotic solvent is 0.045 mol or more.

10 Claims, 7 Drawing Sheets

(58) Field of Classification Search
USPC ..... 205/238, 261
See application file for complete search history.

(56) References Cited

FOREIGN PATENT DOCUMENTS

| | | | | | |
|---|---|---|---|---|---|
| CN | 110336079 | A | * | 10/2019 | ..... H01M 10/054 |
| JP | 2001-23685 | A | | 1/2001 | |
| JP | 2014-504423 | A | | 2/2014 | |
| JP | 2014-165185 | A | | 9/2014 | |
| JP | 2014-186940 | A | | 10/2014 | |
| WO | 2013/157187 | A1 | | 10/2013 | |
| WO | 2014/168218 | A1 | | 10/2014 | |

OTHER PUBLICATIONS

WIPO, International Search Report for International Application No. PCT/JP2021/006605, Apr. 6, 2021.
WIPO, Written Opinion for International Application No. PCT/JP2021/006605, Apr. 6, 2021.
Vito Di Noto, Electrical Spectroscopy Studies of Lithium and Magnesium Polymer Electrolytes Based on PEG400, The Journal of Physical Chemistry B, Oct. 8, 2002, pp. 11139-11154 (in particular, abstract), vol. 106, No. 43.
Doron Aurbach et al., Journal of the Electrochemical Society, 148, A1004-A1014 (2001) (Described in the original specification of the present application as filed).
Masatsugu Oishi et al., Journal of the Electrochemical Society, 161, A943-A947 (2014) (Described in the original specification of the present application as filed).
Shuijian He et al., Journal of Materials Chemistry A, 5, 12718-12722 (2017) (Described in the original specification of the present application as filed).
Jian Luo et al., ACS Energy Letters, 2, 1197-1202 (2017) (Described in the original specification of the present application as filed).
EPO, Extended European Patent Application No. 21808946.4, Jun. 5, 2024.
Haiyan Fan: "Extending Cycle Life of Mg/S Battery by Activation of Mg Anode/Electrolyte Interface through an LiCl-Assisted MgCl, Solubilization Mechanism", Advanced Functional Materials, vol. 30, No. 9, XP093166127, DE ISSN: 1616-301X, DOI: 10.1002/adfm.201909370 Retrieved from the Internet URL: https://onlinelibrary.wiley.com/doi/full-xml/10.1002/adfm.201909370, Dec. 23, 2019.

* cited by examiner

ELECTROLYTIC SOLUTION, MAGNESIUM PRODUCTION METHOD, MAGNESIUM, AND MAGNESIUM FOIL

FIELD

The present invention relates to an electrolytic solution for generating magnesium electrodeposition and a magnesium production method using the electrolytic solution. The present invention also relates to magnesium and a magnesium foil obtained by the magnesium production method using the electrolytic solution.

BACKGROUND

Magnesium is an industrially useful metal and is used as an additive element in various structural materials and alloys. In recent years, magnesium has also attracted attention to application for the negative electrode of magnesium secondary batteries because of its high electrical capacity. The magnesium secondary batteries are operated by discharging the batteries due to dissolving magnesium at the negative electrode and charging due to electrochemically depositing magnesium. Therefore, a technology for mass production of magnesium foils used as the negative electrode has been required.

Conventionally, magnesium foils have been produced by rolling. However, magnesium exhibits crystals of a hexagonal close-packed structure and thus has only one active slip surface by rolling. Therefore, rolling magnesium to a thickness of several tens of micrometers requires an enormous number of rolling operations. Therefore, the production of magnesium foils by rolling has been costly. The magnesium foils produced by rolling have a natural oxide film or a hydration film formed on the surface of the foils. Therefore, smooth dissolution and deposition of magnesium are inhibited when the magnesium foils produced by rolling are used as the negative electrodes of the magnesium secondary batteries.

In order to solve these problems, the production of magnesium foils by electrolytic processes in non-aqueous solvents has been studied instead of the production of magnesium foils by rolling.

Here, magnesium is a metal that has an electrochemically much less noble potential than the reduction potential of protons. Therefore, high-temperature molted salt is required to be used in order to deposit the magnesium foils by the electrolytic process. For example, in electrolytic smelting of magnesium, the bath temperature of the molted salt is around 700° C. In such electrolytic refining, the bath temperature of the molted salt exceeds the melting point of magnesium (650° C.) and thus the electrolytic refining is inapplicable for mass production of the magnesium foils. Therefore, development of an electrolytic solution in which magnesium is electrochemically deposited at lower temperatures, in particular near normal temperature is required. Such an electrolytic solution can also be used as an electrolytic solution that is filled in the magnesium secondary batteries.

In the early stage of the development of such an electrolytic solution, it has been found that magnesium is electrodeposited at the normal temperature by dissolving Grignard reagents in an ether-based solvent. However, Grignard reagents are highly reactive with water and oxygen and thus there are safety issues such as the possibility of ignition in some cases. Therefore, this technology has not been put to practical use as the electrolytic solution for electrodepositing magnesium at the normal temperature or the electrolytic solution for the magnesium secondary batteries.

A next electrolytic solution that has been developed is an electrolytic solution in which a complex represented by $Mg(AlR_1R_2X_2)_2$ ($R_2$, $R_2$: an alkyl anion, an allyl anion, and the like, X: halide ion) is dissolved in an ether-based solvent and is described in Non Patent Literature 1. This complex includes Mg salt that includes alkyl anions described as $R_2$, $R_2$ and thus is highly reactive with water and oxygen as in the case of Grignard reagents. In addition, the production cost is high due to the complexity of synthesis and other factors and thus this complex is difficult to use in industry.

As described in Non Patent Literature 2, $Mg(TFSA)_2$ has been developed as other Mg salts other than these Mg salts. However, the technology described in Non Patent Literature 2 has the problems of production cost and reduction stability. As described in Patent Literature 1 and Non Patent Literatures 3 and 4, electrolytic solutions in which magnesium chloride and aluminum chloride are dissolved in 1,2-dimethoxyethane have also been developed. However, the electrolytic solutions described in these Literatures are highly reactive with water because aluminum chloride is a strong Lewis acid. In addition, the electrolytic solutions described in these Literatures have the problem of corroding the electrodeposited magnesium. Furthermore, the electrolytic solutions in these Literatures have the problem in which the electrolytic solution itself deteriorates due to the electrodeposition. Therefore, the technologies in these Literatures have not been put into practical use. In order to solve these problems, addition of Mg metal powder to the electrolytic solution has also been attempted. However, Mg metal powder is expensive and thus has a problem of cost.

More recently, as described in Patent Literature 2, electrolytic solutions in which magnesium chloride is dissolved in tetrahydrofuran (THF) or electrolytic solutions in which both magnesium chloride and lithium chloride are dissolved in THF have been developed. Patent Literature 2 has described that the deposited product of the negative electrode active material including magnesium is formed on the surface of the negative electrode collector by immersing the negative electrode collector in the electrolytic solution and applying reducing current.

CITATION LIST

Patent Literature

Patent Literature 1: Japanese Patent Publication Laid-open No. 2014-186940

Patent Literature 2: WO 2013/157187 Pamphlet

Non Patent Literature

Non Patent Literature 1: Doron Aurbach et al., Journal of The Electrochemical Society, 148, A1004-A1014 (2001)

Non Patent Literature 2: Masatsugu Oishi et al., Journal of The Electrochemical Society, 161, A943-A947 (2014)

Non Patent Literature 3: Shuijian He et al., Journal of Materials Chemistry A, 5, 12718-12722 (2017)

Non Patent Literature 4: Jian Luo et al., ACS Energy Letters, 2, 1197-1202 (2017)

SUMMARY

Technical Problem

As described above, development of the electrolytic solutions for mass production of the magnesium foils by the electrolytic process has been developed. However, the technologies described in Patent Literatures 1 and Non Patent Literatures 1 to 4 have not been put to practical use due to problems of safety, corrosion resistance, and production cost. In the technology described in Patent Literature 2, the concentrations of magnesium chloride and lithium chloride in the electrolytic solution are relatively low and thus a current density when the reduction current is applied is extremely low. Therefore, the deposited product has a specific shape in which magnesium cannot be deposited uniformly. Therefore, the technology described in Patent Literature 2 is not suitable for the mass production of the magnesium foils by the electrolytic process.

In view of such problems, an object of the present invention is to provide an electrolytic solution that can electrodeposit magnesium near the normal temperature and increase the current density. An object of the present invention is also to develop a magnesium production method and a magnesium foil production method using such an electrolytic solution.

Solution to Problem

As a result of intensive study, the inventors of the present invention have newly found that magnesium can be electrodeposited and the current density during the electrodeposition is significantly increased in an electrolytic solution in which magnesium chloride and lithium chloride are dissolved in an aprotic solvent at specific concentrations. This invention is based on such new findings.

The electrolytic solution according to the present invention includes magnesium chloride, lithium chloride, and an aprotic solvent, in which the magnesium chloride and the lithium chloride are dissolved in a total concentration of 0.09 mol or more relative to 1 mol of the aprotic solvent, and the magnesium chloride is dissolved in a concentration of 0.045 mol or more relative to 1 mol of the aprotic solvent.

In the present invention, it is desirable that the magnesium chloride is dissolved in a concentration of 0.08 mol or more relative to 1 mol of the aprotic solvent.

In the present invention, it is desirable that the magnesium chloride and the lithium chloride are dissolved in a total concentration of 0.16 mol or more relative to 1 mol of the aprotic solvent.

In the present invention, a ratio of molar concentrations of the magnesium chloride and the lithium chloride can be set to 1:1 to 3:1.

In the present invention, the aprotic solvent can be an aprotic solvent having an unshared electron pair.

In the present invention, the aprotic solvent can be at least one aprotic solvent selected from the group consisting of ethylene carbonate, propylene carbonate, butylene carbonate, dimethyl carbonate, diethyl carbonate, ethylmethyl carbonate, γ-butyrolactone, γ-valerolactone, γ-octanoic lactone, ethylene oxide, oxetane, tetrahydrofuran, tetrahydropyran, 2-methyltetrahydrofuran, 1,3-dioxolane, 1,2-dimethoxyethane, 1,2-diethoxyethane, diethylene glycol dimethyl ether, triethylene glycol dimethyl ether, tetraethylene glycol dimethyl ether, 3-methyl-2-oxazolidone, methyl acetate, acetonitrile, dimethyl sulfoxide, and sulfolane.

In the present invention, the aprotic solvent can be a cyclic ether having a carbon number of 2 to 5.

A magnesium production method according to the present invention includes electrodepositing magnesium using the electrolytic solution as described above.

In the present invention, it is desirable that magnesium is electrodeposited under a condition of a current density of 10 $mA/cm^2$ or more.

In the present invention, magnesium can be electrodeposited at a solution temperature of the electrolytic solution set at the normal temperature.

In addition, the present invention can also include magnesium obtained by the production method as described above.

Furthermore, a magnesium production method according to the present invention includes applying electroplating by immersing a workpiece in the electrolytic solution as described above and forming a plating layer on a surface of the workpiece.

In the present invention, it is desirable that the electroplating is applied to the workpiece under a condition of a current density of 10 $mA/cm^2$ or more.

In the present invention, electroplating can be applied to the workpiece at a solution temperature of the electrolytic solution set at the normal temperature.

In addition, the present invention can include a magnesium foil deposited as the plating layer by the magnesium production method as described above.

Advantageous Effects of Invention

Use of the electrolytic solution according to the present invention allows magnesium to be electrodeposited. In addition, the current density can be increased at the time of the electrodeposition.

DESCRIPTION OF EMBODIMENTS

Figure 1:
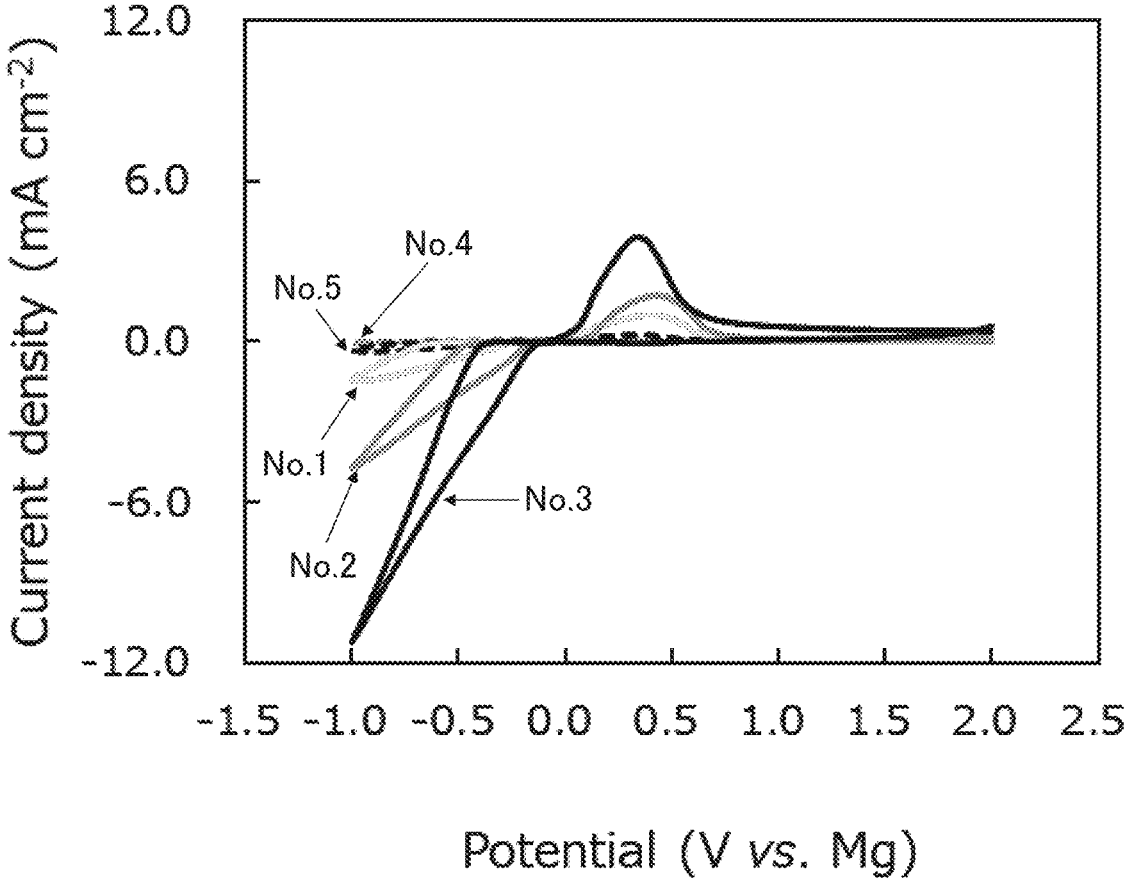
FIG. 1 is a graph of cyclic voltammograms of electrolytic solutions in Examples 1 to 3 and Comparative Examples 1 and 2.

Hereinafter, embodiments of the electrolytic solution and the method of producing magnesium to which the present invention is employed. Here, the present invention is not limited to only the following embodiments. In addition, constituents in the embodiments can be appropriately combined in a part or in the whole. In this specification, in the case where a numerical range is represented by a lower limit and an upper limit using the term "to", both of the lower limit and the upper limit are included.

[1. Electrolytic Solution]

The electrolytic solution according to the embodiments in this example includes magnesium chloride, lithium chloride, and an aprotic solvent. In the electrolytic solution in this example, magnesium chloride and lithium chloride are dissolved in a total concentration of 0.09 mol or more relative to 1 mol of the aprotic solvent. In addition, in the electrolytic solution in this example, magnesium chloride is dissolved in a concentration of 0.045 mol or more relative to 1 mol of the aprotic solvent. The electrolytic solution in this example includes magnesium chloride and lithium chloride as electrolytes and includes the aprotic solvent as a solvent to dissolve these electrolytes.

Examples of the aprotic solvents include carbonates such as ethylene carbonate, propylene carbonate, butylene carbonate, dimethyl carbonate, diethyl carbonate, and ethylmethyl carbonate; lactones such as γ-butyrolactone, γ-valerolactone, and γ-octanoic lactone; ethers such as ethylene oxide, oxetane, tetrahydrofuran, tetrahydropyran, 2-methyltetrahydrofuran, 1,3-dioxolane, 1,2-dimethoxyethane, 1,2-diethoxyethane, diethylene glycol dimethyl ether, triethylene glycol dimethyl ether, tetraethylene glycol dimethyl ether, and 3-methyl-2-oxazolidone; esters such as methyl acetate; nitriles such as acetonitrile; and sulfoxides such as dimethyl sulfoxide and sulfolane. These aprotic solvents may be used singly or in combination of two or more of them.

The aprotic solvent is preferably an aprotic polar solvent having an unshared electron pair. Ethers are preferable as the aprotic solvents and cyclic ethers having a carbon number of 2 to 5 such as ethylene oxide, oxetane, tetrahydrofuran, and tetrahydropyran are more preferable. Furthermore, the aprotic solvent is further preferably cyclic ethers having a carbon number of 3 to 5 such as oxetane, tetrahydrofuran, and tetrahydropyran. Of these aprotic solvents, tetrahydrofuran (THF) is a particularly preferable aprotic solvent.

Usually, in the electrolytic solution, magnesium chloride and lithium chloride are dissolved in a total concentration of 0.09 mol or more relative to 1 mol of the aprotic solvent. In the electrolytic solution, magnesium chloride and lithium chloride are preferably dissolved in a total concentration of 0.11 mol or more, more preferably dissolved in a total concentration of 0.13 mol or more, further preferably dissolved in a total concentration of 0.15 mol or more, and particularly preferably dissolved in a total concentration of 0.16 mol or more relative to 1 mol of the aprotic solvent, The upper limit of the total concentration of magnesium chloride and lithium chloride dissolved in the electrolytic solution is not particularly limited. As long as the total concentration of magnesium chloride and lithium chloride is 0.3 mol or less relative to 1 mol of the aprotic solvent, magnesium chloride and lithium chloride are easily dissolved in the aprotic solvent.

In addition, magnesium chloride is usually dissolved in the electrolytic solution in a concentration of 0.045 mol or more relative to 1 mol of the aprotic solvent. Here, in the electrolytic solution, magnesium chloride is preferably dissolved in a concentration of 0.05 mol or more, more preferably dissolved in a concentration of 0.06 mol or more, further preferably dissolved in a concentration of 0.07 mol or more, and particularly preferably dissolved in a concentration of 0.08 mol or more relative to 1 mol of the aprotic solvent. The upper limit of the concentration of magnesium chloride dissolved in the electrolytic solution is not particularly limited. As long as the upper limit of the concentration of magnesium chloride is 0.2 mol or less, magnesium chloride and lithium chloride are easily dissolved in the aprotic solvent.

In the electrolytic solution, the molar concentration of magnesium chloride is usually approximately equal to that of lithium chloride. The molar concentration of magnesium chloride, however, may be higher than that of lithium chloride. The ratio of the molar concentration of magnesium chloride to lithium chloride may be set to 1 or more, may be set to 1.1 or more, or may be set to 1.5 or more. The ratio of the molar concentration of magnesium chloride to lithium chloride may be 3 or less and may be 2.5 or less. In other words, the ratio of the molar concentration of magnesium chloride to lithium chloride is preferably 1:1 to 3:1. More specifically, the ratio of the molar concentration of magnesium chloride to lithium chloride may be 1:1 to 2.5:1 or may be 1:1 to 2:1. The ratio of the molar concentration of magnesium chloride to lithium chloride may be 1.1:1 to 3:1 or may be 1.5:1 to 3:1. The ratio of the molar concentration of magnesium chloride to lithium chloride may be 1.1:1 to 2.5:1 or may be 1.5:1 to 2.5:1. Here, in the case where the molar concentration of magnesium chloride exceeds three times the molar concentration of lithium chloride, a significant increase in the current density is not observed. Therefore, the molar concentration of magnesium chloride is preferably three times or less the molar concentration of lithium chloride.

The concentration of lithium chloride in the electrolytic solution is not limited as long as the concentration of lithium chloride satisfies the above relationship with magnesium chloride. Magnesium chloride is preferably dissolved in a concentration of 0.04 mol or more, more preferably dissolved in a concentration of 0.045 mol or more, further preferably dissolved in a concentration of 0.06 mol or more, and particularly preferably dissolved in a concentration of 0.08 mol or more relative to 1 mol of the aprotic solvent. The upper limit of the concentration of lithium chloride dissolved in the electrolytic solution is not particularly limited. As long as the upper limit of the concentration of lithium chloride is 0.2 mol or less, magnesium chloride and lithium chloride are easily dissolved in the aprotic solvent.

As described above, in the electrolytic solution in this example, magnesium chloride and lithium chloride are dissolved in the aprotic solvent at given concentrations. Here, in this specification, the concentration in which the electrolyte such as magnesium chloride or lithium chloride is dissolved in the electrolytic solution is determined as the concentration of the solute actually dissolved in the electrolytic solution. Here, in the case where the electrolyte such as magnesium chloride or lithium chloride is completely dissolved in the aprotic solvent, the concentration in which the electrolyte is calculated from the charged amount of the electrolyte can be regarded as the dissolved concentration. On the other hand, in the case where the electrolyte such as magnesium chloride or lithium chloride is not completely dissolved in the aprotic solvent, the concentration of the dissolved electrolyte is not the concentration calculated from the charged amount of the electrolyte but the value measured by inductively coupled plasma (ICP) emission analysis or the like.

In addition to the above metal salts, the electrolytic solution may include other metal salts such as calcium chloride and other additives such as brightening agents for electrolytic plating. In addition to the aprotic solvent, the electrolytic solution may include other solvents such as water and organic solvents.

[2. Method for Producing Electrolytic Solution]

The electrolytic solution is made by dissolving magnesium chloride and lithium chloride in the aprotic solvent in the above respective given concentrations. Magnesium chloride and lithium chloride may be dissolved by charging these salts into the aprotic solvent and stirring for a given time or longer time. At this operation, magnesium chloride and lithium chloride are preferably dissolved by simultaneously charging and stirring these salts. Magnesium chloride, however, may be charged and stirred first and thereafter lithium chloride may be charged and further stirred or lithium chloride may be charged and stirred first and thereafter magnesium chloride may be charged and further stirred.

At the time of the dissolution, the solution temperature may be set to room temperature or the solution temperature may be set to a temperature higher than room temperature, for example 60° C. or more, in order to increase the dissolution rate. A stirring time for dissolving magnesium chloride and lithium chloride depends on the concentrations of magnesium chloride and lithium chloride. In the case where the solution temperature is set to room temperature, the stirring time is preferably set to 24 hours or more. In the case where the solution temperature is set to 60° C., the stirring time is preferably set to 5 hours or more. Here, in this specification, the room temperature refers to a temperature in a range of 15° C. to 25° C. After magnesium chloride and lithium chloride are charged and stirred, electrolytes such as magnesium chloride, lithium chloride, and the like that are not dissolved may be separated from the electrolytic solution by filtration to obtain the electrolytic solution having a desired concentration.

[3. Applications of Electrolytic Solution]

The electrolytic solution in this example can be used for producing magnesium and a magnesium foil. In other words, magnesium can be produced by electrodepositing magnesium using the electrolytic solution in this example. In the magnesium production method by electrodepositing magnesium using the electrolytic solution in this example, magnesium can be deposited with the solution temperature of the electrolytic solution being set to the normal temperature. Here, in this specification, the normal temperature refers to normal temperature in the field of electrochemistry or molted salts and refers to a temperature in a range of 0° C. to 100° C.

More specifically, in such a production method, a positive electrode and a negative electrode are immersed in the electrolytic solution of this example and voltage is applied. Platinum, gold, silver, molybdenum, aluminum, copper, nickel, carbon, and the like can be used as the positive electrode. Magnesium or magnesium alloys can be used as the negative electrode. The solution temperature of the electrolytic solution is usually set to the normal temperature.

In such a production method, the electrodeposition can be usually performed at a current density of 1 mA/cm$^2$ or higher. The current density for electrodepositing magnesium using the electrolytic solution in this example is preferably 10 mA/cm$^2$ or more, more preferably 20 mA/cm$^2$ or more, further preferably 30 mA/cm$^2$ or more, particularly preferably 40 mA/cm$^2$ or more, and most preferably 50 mA/cm$^2$ or more. Setting the current density to the lower limit value or more of the above numerical range facilitates magnesium to be deposited in the form of a dense film in a uniform state. In addition, depositing magnesium efficiently in a short period of time facilitates improvement in productivity. The upper limit value of the current density is not particularly limited and is preferably 200 mA/cm$^2$ or less and more preferably 100 mA/cm$^2$ or less. Setting the current density to the upper limit value or less of the above numerical range facilitates deposition of magnesium in the dendrite-like form to be reduced.

As the magnesium production method using the electrolytic solution in this example, an embodiment of applying electroplating by immersing a workpiece in the electrolytic solution in this example and forming a plating layer on a surface of the workpiece can be employed. In the magnesium production method in which electrolytic plating is applied on the surface of the workpiece using the electrolytic solution in this example, the plating layer can be formed by setting the solution temperature of the electrolytic solution to the normal temperature. According to such a production method, magnesium is deposited on the surface of the workpiece as the plating layer. Therefore, production of the magnesium foil becomes easy.

In production method in this embodiment, magnesium or a magnesium alloy used as the positive electrode and the workpiece used as the negative electrode are immersed in the electrolytic solution of this example and voltage or current is applied. The workpiece is made of conductive materials. The workpiece desirably has a smooth surface. For example, conductive metals such as copper, platinum, and aluminum can be used as the workpiece. The solution temperature of the electrolytic solution can be set to the normal temperature.

In addition, in the production method according to this embodiment, the electrolytic plating can usually be applied to the workpiece under a condition of a current density of 1 mA/cm$^2$ or more. The current density for electrodepositing magnesium using the electrolytic solution in this example is preferably 10 mA/cm$^2$ or more, more preferably 20 mA/cm$^2$ or more, further preferably 30 mA/cm$^2$ or more, particularly preferably 40 mA/cm$^2$ or more, and most preferably 50 mA/cm$^2$ or more. Setting the current density to the lower limit value or more of the above numerical range facilitates the plated layer to be formed in the form of a dense film in a uniform state. In addition, depositing magnesium efficiently in a short period of time facilitates improvement in productivity. The upper limit value of the current density is not particularly limited and is preferably 200 mA/cm$^2$ or less and more preferably 100 mA/cm$^2$ or less. Setting the current density to the upper limit value or less of the above numerical range facilitates deposition of magnesium in the dendrite-like form to be reduced.

In addition, the electrolytic solution in this example can also be used as an electrolytic solution for the magnesium secondary battery. The magnesium secondary battery includes a negative electrode and a positive electrode arranged so that a separator is sandwiched between the negative electrode and the positive electrode in a cell filled with the electrolytic solution. Magnesium or a magnesium alloy is used for the negative electrode. Transition metal oxides, electron-accepting materials (for example, oxidizing agents), magnesium-absorbing materials, and the like are used for the positive electrode. The magnesium secondary battery is discharged by dissolving magnesium at the negative electrode and reacting magnesium ions moving in the electrolytic solution with the positive electrode. In addition, the magnesium secondary battery is charged by reacting the magnesium ions moving in the electrolytic solution with the negative electrode to electrochemically deposit magnesium.

Here, the magnesium and the magnesium foil produced by the production method in this example can be used as the negative electrode of such a magnesium secondary battery.

[4. Operation Effect]

The electrolytic solution in this example is an electrolytic solution including magnesium chloride, lithium chloride, and the aprotic solvent. Therefore, the electrolytic solution that has excellent safety, corrosion resistance, and cost and can electrodeposit magnesium near the normal temperature can be provided.

In the electrolytic solution of this example, magnesium chloride and lithium chloride are dissolved in the given concentrations. This allows the solubility of magnesium chloride to be increased as compared to magnesium chloride alone and thus the current density to be increased when the electrodeposition is performed using the electrolytic solution of this example.

Furthermore, performing electrodeposition using the electrolytic solution of this example allows magnesium to be deposited in the form of a dense film in a uniform state. In addition, magnesium alone can be selectively deposited. Therefore, use of the electrolytic solution of this example facilitates the mass production of magnesium by the electrolytic process. In addition, the electrolytic solution of this example can be used as an electrolytic solution to be filled in the magnesium secondary battery.

Here, generally, the current density increases as the electrolyte concentration increases and the electrolytic solution of this example has the unique property in which the current density significantly increases as the electrolyte concentration increases.

In other words, the electrolytic solution in which the total concentration of magnesium chloride and lithium chloride is increased to 0.09 mol or more significantly increases the current density as compared to an electrolytic solution in which the total concentration of magnesium chloride and lithium chloride is in a lower concentration range.

The reason for the significant increase in the current density with increase in the electrolyte concentrations of magnesium chloride and lithium chloride and the reason for the changes in the current density that appear when the dissolution ratio of magnesium chloride and lithium chloride is changed are not necessarily clear. However, it is presumed that the following mechanisms contribute.

With respect to electrolytic solutions, it has been known that in the systems including magnesium chloride and the aprotic solvent, the aprotic solvent coordinates to the magnesium ions included in the electrolytic solution. More specifically, in the aprotic solvents that have unshared electron pairs and polarity (aprotic polar solvents), oxygen atoms, nitrogen atoms, chlorine atoms, and other atoms having the unshared electron pairs coordinate to magnesium ions. As an example, with respect to THF, the oxygen atoms in THF coordinate to the magnesium ions. Hereinafter, description is made using THF as an example of the aprotic solvent and the same can be inferred for other aprotic solvents.

Magnesium ions have a high charge density and are classified as a hard Lewis acid. Therefore, it is conceivable that the reason why the aprotic solvent is coordinated to the magnesium ions is because the affinity of the unshared electron pair of the oxygen atom having a high charge density to the magnesium ions is high and the aprotic solvent forms a complex with the magnesium ions. It is also conceivable that the electrochemical deposition and dissolution of magnesium at the normal temperature are caused due to the activity of the complex in which the aprotic solvent is coordinated to the magnesium ions. In particular, the complex in which THF is coordinated to the magnesium ions are active in many cases and THF is suitable as the solvent of the electrolytic solution. Lithium ions, which is similar to magnesium ions, are also classified as a hard Lewis acid and thus it is presumed that the aprotic solvent is coordinated to the lithium ions in the same manner.

In the present invention, magnesium chloride and lithium chloride are dissolved in a total concentration of 0.09 mol or more relative to 1 mol of the aprotic solvent and magnesium chloride is dissolved in a concentration of 0.045 mol or more relative to 1 mol of the aprotic solvent. This specifies the total concentration of magnesium chloride and lithium chloride and the concentration of magnesium chloride so that THF exists in a range of approximately 6 mol or less relative to 1 mol of each magnesium ion and lithium ion. This allows a magnesium chloride-THF complex serving as the active species in the electrochemical deposition and dissolution reaction of magnesium to be formed in the solution and solvation to the magnesium chloride-THF complex caused by excess THF to be reduced, whereby the electrochemical deposition and dissolution of magnesium is promoted and thus the current density can be easily increased.

In addition, in the present invention, magnesium chloride is preferably dissolved in a concentration of 0.08 mol or more relative to 1 mol of the aprotic solvent. This specifies the concentration of magnesium chloride so that THF exists in a range of approximately 6 mol or less relative to 1 mol of magnesium chloride. As described above, this allows the magnesium chloride-THF complex to be further formed by increasing the dissolution amount of magnesium chloride and the concentration of the complex serving as the active species to increase. The increase in the amount of the complex results in a higher ratio of an unsolvated magnesium chloride-THF complex. These actions allow the current density to be further easily increased.

In the present invention, the ratio of the molar concentration of magnesium chloride to lithium chloride is preferably 1:1 to 3:1. This ratio is specified so that the molar concentration of magnesium chloride is equal to or higher than that of lithium chloride. In the case where more lithium chloride is included than magnesium chloride, although a lithium chloride-THF complex made of lithium chloride and THF alone is further formed with an increase in the concentration of lithium chloride, the lithium chloride-THF complex is not involved in the electrochemical deposition and dissolution reaction of magnesium. On the other hand, setting a similar or higher molar concentration of magnesium chloride than that of lithium chloride facilitates an increase in the magnesium chloride-THF complex serving as the active species and thus the current density can be easily increased.

In the present invention, magnesium chloride and lithium chloride are preferably dissolved in a total concentration of 0.16 mol or more relative to 1 mol of the aprotic solvent. This specifies the total concentration of magnesium chloride and lithium chloride so that THF exists in a range of approximately 6 mol or less relative to 1 mol of the total of magnesium chloride and lithium chloride. This allows the current density to be further easily increased because a large part of THF existing in the solution is coordinated to the magnesium ions and lithium ions and thus almost no THF solvating to the magnesium ion-THF complex and lithium ion-THF complex exists.

EXAMPLES

Hereinafter, electrolytic solutions in Examples will be described. Tests using the electrolytic solutions in Examples and test results will also be described. In each Example, THF (super dehydrated) manufactured by FUJIFILM Wako Pure Chemical Corporation was used as THF. Magnesium chloride (anhydrous, 99.99%) manufactured by Sigma-Aldrich Co. LLC was used as magnesium chloride. Lithium chloride (reagent special grade) manufactured by FUJIFILM Wako Pure Chemical Corporation was used as lithium chloride. The present invention is not limited to the following Examples.

Examples 1 to 3

An electrolytic solution in Example 1 was obtained as a uniform solution by dissolving magnesium chloride and lithium chloride so as to be 0.049 mol each relative to 1 mol of THF. Therefore, magnesium chloride and lithium chloride were dissolved in a total concentration of 0.098 mol (more than 0.09 mol) relative to 1 mol of THF. The ratio of the molar concentration of magnesium chloride to lithium chloride was 1:1.

An electrolytic solution in Example 2 was obtained as a uniform solution by dissolving magnesium chloride and lithium chloride so as to be 0.065 mol each relative to 1 mol of THF. Therefore, magnesium chloride and lithium chloride were dissolved in a total concentration of 0.13 mol (more than 0.09 mol) relative to 1 mol of THF. The ratio of the molar concentration of magnesium chloride to lithium chloride was 1:1.

An electrolytic solution in Example 3 was obtained as a uniform solution by dissolving magnesium chloride and lithium chloride so as to be 0.081 mol each relative to 1 mol of THF. Therefore, magnesium chloride and lithium chloride were dissolved in a total concentration of 0.162 mol (more than 0.09 mol) relative to 1 mol of THF. In this Example, magnesium chloride and lithium chloride were dissolved in a total concentration of 0.16 mol or more relative to 1 mol of THF. The ratio of the molar concentration of magnesium chloride to lithium chloride was 1:1.

In Examples 1 to 3, the solution temperature was set to 60° C. in order to increase the dissolution rate at the time of dissolving magnesium chloride and lithium chloride in THF. Magnesium chloride and lithium chloride were dissolved in THF by stirring for 24 hours or more, even when the solution temperature remained at the normal temperature.

Comparative Examples 1 and 2

In order to verify the properties of the electrolytic solutions in Examples, electrolytic solutions in Comparative Examples were prepared. In Comparative Examples 1 and 2, electrolytic solutions were obtained by dissolving magnesium chloride and lithium chloride so that the total concentrations were less than 0.09 mol relative to 1 mol of THF.

An electrolytic solution in Comparative Example 1 was obtained as a uniform solution by dissolving magnesium chloride and lithium chloride so as to be 0.020 mol each relative to 1 mol of THF. Therefore, in Comparative Example 1, magnesium chloride and lithium chloride were dissolved in a total concentration of 0.040 mol relative to 1 mol of THF. The ratio of the molar concentration of magnesium chloride to lithium chloride was 1:1.

An electrolytic solution in Comparative Example 2 was obtained as a uniform solution by dissolving magnesium chloride and lithium chloride so as to be 0.041 mol each relative to 1 mol of THF. Therefore, in Comparative Example 2, magnesium chloride and lithium chloride were dissolved in a total concentration of 0.082 mol relative to 1 mol of THF. The ratio of the molar concentration of magnesium chloride to lithium chloride was 1:1.

In Comparative Examples 1 and 2, magnesium chloride and lithium chloride were dissolved in THF at a solution temperature of 60° C. In Comparative Examples 1 and 2, magnesium chloride and lithium chloride can also be dissolved in THF in the state with the solution temperature set at the normal temperature.

Test 1

In Test 1, first, a three-pole electrochemical measurement cell was filled with each of the electrolytic solutions in Examples 1 to 3 and Comparative Examples 1 and 2 to perform cyclic voltammetry (CV) measurement. The solution temperature of the electrolytic solutions was the normal temperature.

In the three-pole electrochemical measurement cell, a platinum plate was used for the working electrode and magnesium wires were used for a reference electrode and a counter electrode. In the working electrode, a working electrode area was determined by a fluororubber O-ring. The current density was calculated by dividing the measured current value by the working electrode area. CV measurement was performed at a scanning speed of 25 mV/s. The measurement was also performed at 1 mV/s and the current density was almost the same. Hereinafter, the electrolytic solutions in Examples 1 to 3 were referred to as Sample Nos. 1 to 3, respectively. The electrolytic solutions in Comparative Examples 1 and 2 were referred to as Sample Nos. 4 and 5, respectively.

Figure 2:
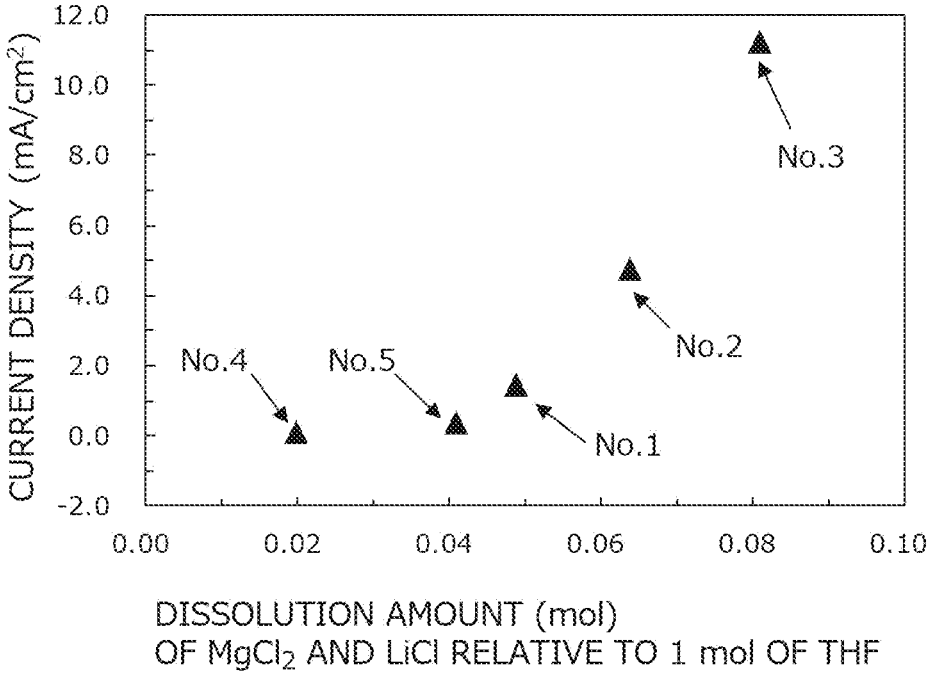
FIG. 2 is a graph illustrating current densities at −1 V in each Example and each Comparative Example obtained by cyclic voltammetry measurement.

FIG. 1 a graph illustrating the cyclic voltammograms of Sample Nos. 1 to 5. FIG. 2 is a graph illustrating the current densities of Sample Nos. 1 to 5 obtained in the CV measurement at −1 V. As is clear from FIG. 1, currents generated due to the electrodeposition and dissolution of magnesium were observed in all Sample Nos. 1 to 5 at the normal temperature. Therefore, electrodeposition and dissolution reversibly occurred in all Sample Nos. 1 to 5.

As illustrated in FIG. 2, an increase in the current density was confirmed as the dissolution amounts of magnesium chloride and lithium chloride relative to 1 mol of THF increased. In particular, it was confirmed that in Sample Nos. 1 to 3 (Examples 1 to 3), in which the total concentrations of magnesium chloride and lithium chloride relative to 1 mol of THF were 0.09 mol or more, the ratio of the current density increase was higher and the current density significantly increased as compared to Sample Nos. 4 and 5 (Comparative Examples 1 and 2), in which the total concentration of magnesium chloride and lithium chloride relative to 1 mol of THF was less than 0.09 mol.

Subsequently, constant potential electrolysis was performed using the electrolytic solution in Example 3 (Sample No. 3) to confirm an electrolysis product. In the constant potential electrolysis, a three-pole electrochemical measurement cell was assembled in the same manner as the manner in the CV measurement and filled with the electrolytic solution in Example 3. The solution temperature of the electrolytic solutions was the normal temperature. In the constant potential electrolysis, −1 V was applied.

Figure 3:
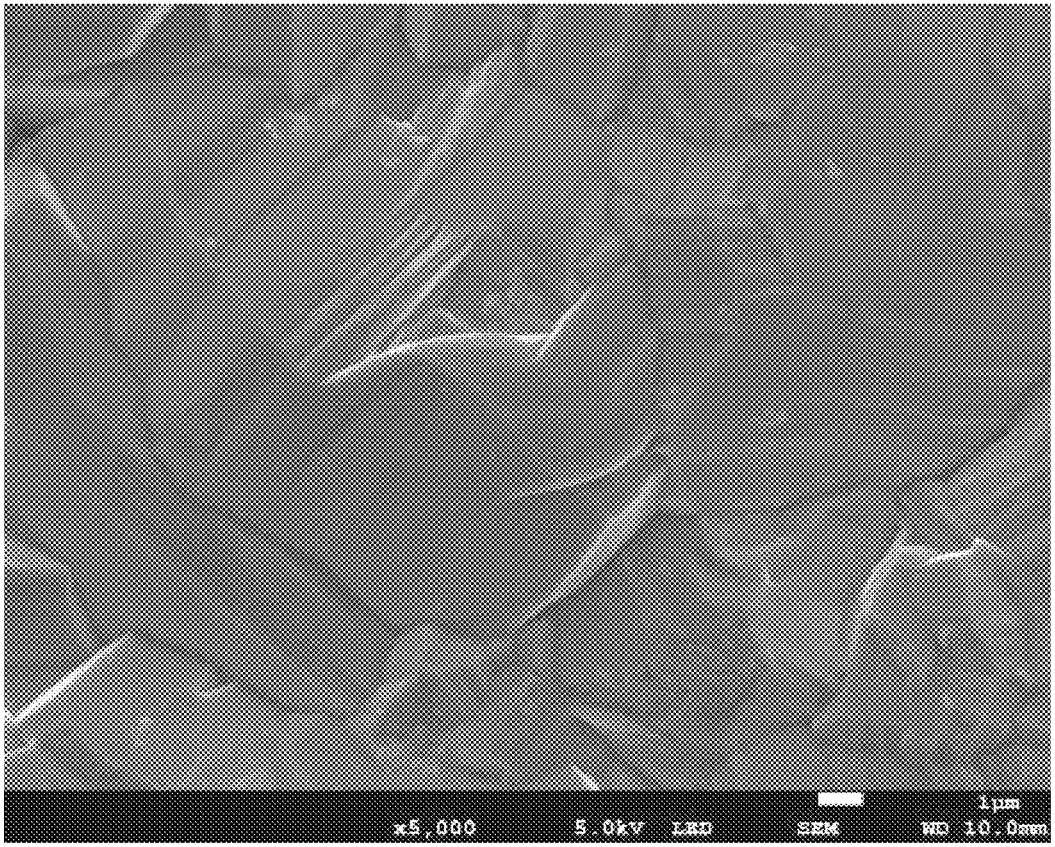
FIG. 3 is a photograph of a scanning electron microscope image of an electrolysis product deposited by constant potential electrolysis using an electrolytic solution in Example 3.
Figure 4:
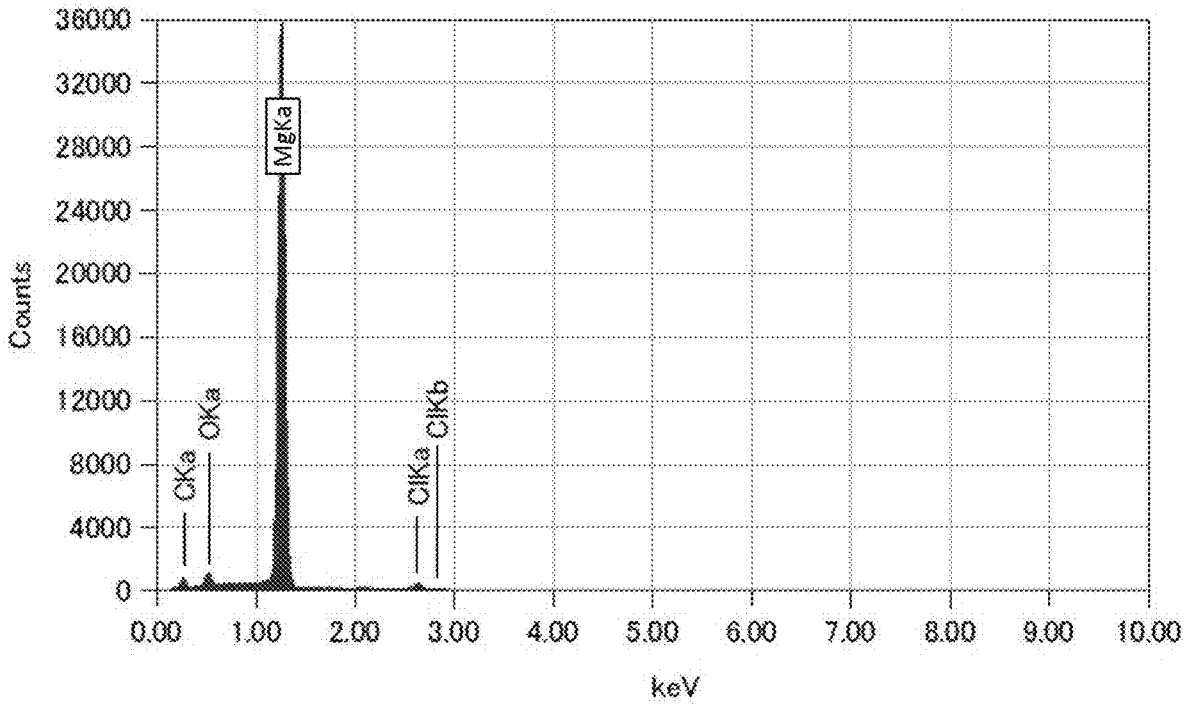
FIG. 4 is a chart of energy dispersive X-ray analysis spectrum of the electrolysis product.
Figure 5:
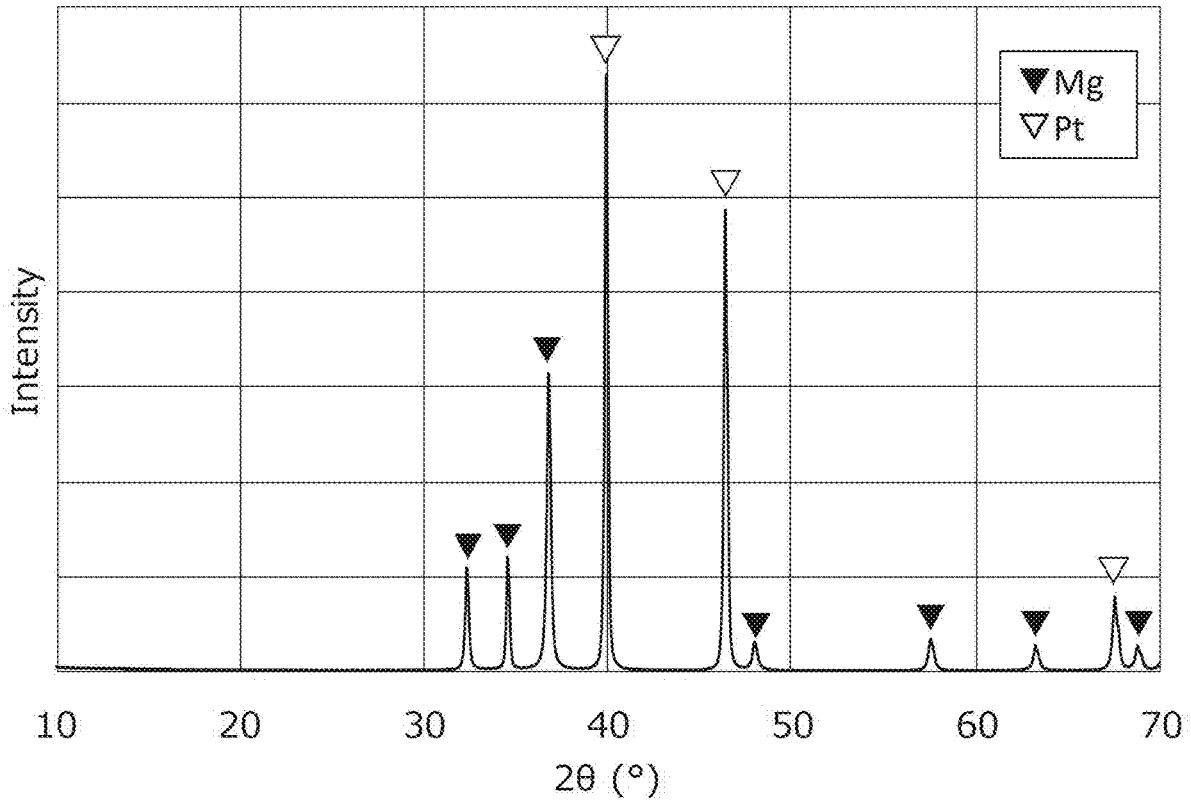
FIG. 5 is a chart of X-ray diffraction spectrum of the electrolysis product.

FIG. 3 is a scanning electron micrograph (SEM photograph) of the electrolysis products deposited by the constant potential electrolysis. FIG. 4 is a chart of energy dispersive X-ray analysis spectrum (EDS spectrum) of the electrolysis product. FIG. 5 is a chart of X-ray diffraction spectrum (XRD spectrum) of the electrolysis product.

As illustrated in FIG. 3, the electrolysis product had a dense and uniform film-like form. As illustrated in FIG. 4, magnesium was mainly detected in the electrolysis product. In addition, as illustrated in FIG. 5, the diffraction peaks of magnesium were obtained in the XRD spectrum. Therefore, the cathodic electrolysis product obtained by the constant potential electrolysis was magnesium.

As a result of quantitative analysis of the electrolysis product determined by ICP emission spectrometry for magnesium and atomic absorption spectrometry for lithium, the contents of magnesium and lithium were 99.94% by mass and 0.06% by mass, respectively. This result confirmed that almost all components of the electrolysis product (deposited product) were magnesium.

Here, the constant potential electrolysis using the electrolytic solution in Example 3 (Sample No. 3) is one embodiment of the magnesium production method in which magnesium is electrodeposited using the electrolytic solution in this example.

Example 4

An electrolytic solution in Example 4 was obtained as a uniform solution by dissolving magnesium chloride and lithium chloride so as to be 0.081 mol and 0.041 mol respectively relative to 1 mol of THF. Therefore, in Example 4, magnesium chloride and lithium chloride were dissolved in a total concentration of 0.122 mol (more than 0.09 mol) relative to 1 mol of THF. In Example 4, the ratio of the molar concentration of magnesium chloride to lithium chloride was 2:1.

In Example 4, the solution temperature was set to 60° C. in order to increase the dissolution rate at the time of dissolving magnesium chloride and lithium chloride in THF. In Example 4, magnesium chloride and lithium chloride were also able to be dissolved in THF by setting the solution temperature to the normal temperature and stirring.

Comparative Example 3

An electrolytic solution in Comparative Example 3 was obtained as a uniform solution by dissolving magnesium chloride and lithium chloride so as to be 0.041 mol and 0.081 mol respectively relative to 1 mol of THF. Therefore, in Comparative Example 3, magnesium chloride and lithium chloride were dissolved in a total concentration of 0.09 mol or more relative to 1 mol of THF. In Comparative Example 3, the ratio of molar concentration of magnesium chloride to lithium chloride is 1:2.

In Comparative Example 3, the solution temperature was set to 60° C. at the time of dissolving magnesium chloride and lithium chloride. In Comparative Examples and 3, magnesium chloride and lithium chloride were also able to be dissolved in THF by setting the solution temperature to the normal temperature and stirring.

Test 2

In Test 2, a three-pole electrochemical measurement cells configured as similar to Test 1 were filled with each of the electrolytic solutions in Example 4 and Comparative Example 3 and CV measurement was performed. The solution temperature of the electrolytic solutions was the normal temperature. The CV measurement was performed at a scanning speed of 25 mV/s. Hereinafter, the case where the electrolytic solution in Example 4 was used was referred to as Sample No. 6 and the case where the electrolytic solution in Comparative Example 3 was used was referred to as Sample No. 7.

Figure 6:
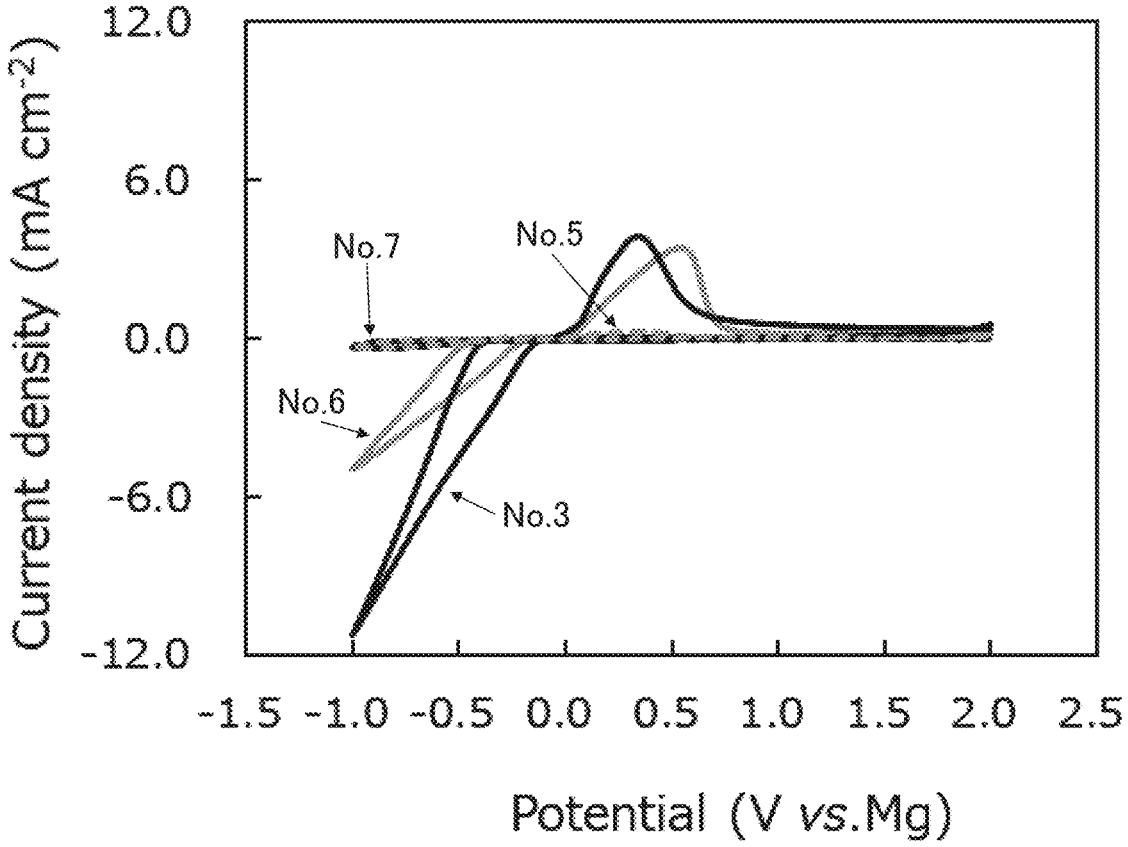
FIG. 6 is a graph of cyclic voltammograms of electrolytic solutions in Examples 3 and 4 and Comparative Examples 2 and 3.

FIG. 6 is a chart illustrating cyclic voltammograms for each of Sample Nos. 6 and 7. In FIG. 6, the CV measurement values of Sample No. 6 and Sample No. 7 are illustrated together with those of Sample No. 3 (Example 3) and Sample No. 5 (Comparative Example 2). As is clear from FIG. 6, currents caused by electrodeposition and dissolution of magnesium were observed in Samples 6 and 7 at the normal temperature. Therefore, electrodeposition and dissolution reversibly occurred in each of Sample Nos. 6 and 7.

Sample No. 6 (Example 4) had twice the amount of dissolved magnesium chloride as compared to Sample No. 5 (Example 2). In Sample No. 6, magnesium chloride and lithium chloride were dissolved in a total concentration of 0.09 mol or more relative to 1 mol of THF. As illustrated in FIG. 6, the current density of Sample No. 6 increased to about five times higher than that of Sample No. 5.

On the other hand, Sample No. 7 (Comparative Example 3) had twice the amount of dissolved lithium chloride as compared to Sample No. 5 (Comparative Example 2). In Sample No. 7, magnesium chloride and lithium chloride were dissolved in a total concentration of 0.09 mol or more relative to 1 mol of THF. However, little change in the current density was observed as compared to Sample No. 5.

Test 3

In Test 3, a three-pole electrochemical measurement cell was filled with the electrolytic solution in Example 3 to produce magnesium at each current density of 5 mA/cm$^2$, 7.5 mA/cm$^2$, 10 mA/cm$^2$, 20 mA/cm$^2$, and 30 mA/cm$^2$. An electrolytic solution in Example 3 was obtained as a uniform solution by dissolving magnesium chloride and lithium chloride so as to be 0.081 mol each relative to 1 mol of THF. In Test 3, a copper foil was used for the working electrode and magnesium wires were used for the reference electrode and the counter electrode. The solution temperature of the electrolytic solution was the room temperature.

In Test 3, magnesium was formed on the surface of the working electrode by varying each applied time at the respective current densities and by applying an amount of electricity to the working electrode that resulted in a predetermined thickness. In addition, in Test 3, each working electrode after the electrolysis was embedded in an epoxy resin with the magnesium formed on each working electrode and the resin was cut and polished to expose a section of the magnesium. Thereafter, the section was observed using an optical microscope to measure film thicknesses at 25 locations in the cross section and the average value of the film thicknesses was used as an average film thickness.

Figure 7:
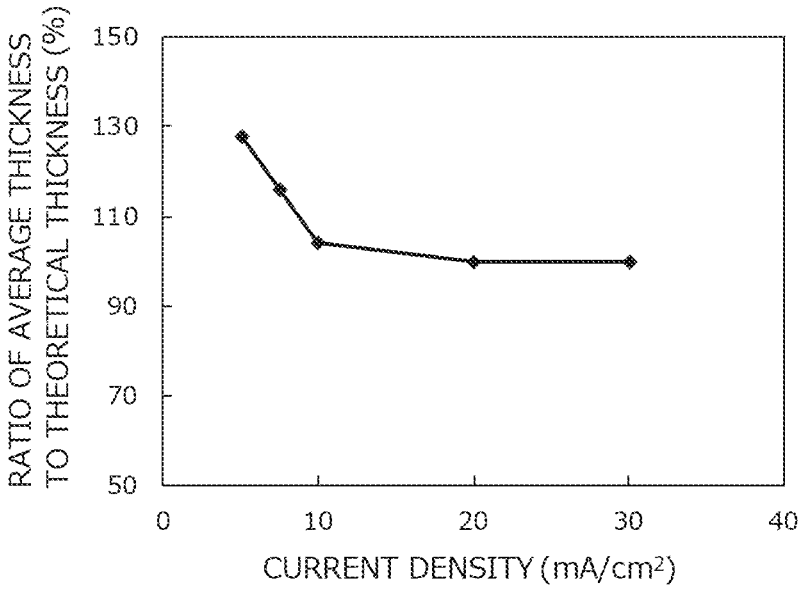
FIG. 7 is a graph illustrating a relationship between a current density at the time of magnesium production and the ratio of an average film thickness relative to theoretical values measured in Test 3.

FIG. 7 is a graph illustrating the average thickness of the magnesium deposited on the working electrode at each current density as a ratio to theoretical values (values calculated from the electrical quantity). As is clear from FIG. 7, the film thicknesses became closer to the theoretical values as the current density increases. The film thicknesses close to the theoretical values were obtained in the current densities of 10 mA/cm$^2$ or more.

Here, in the case where the current density was lower than 10 mA/cm$^2$, the film thickness of the magnesium formed on the surface of the working electrode exceeded the theoretical value. The reason why this is observed is because the sparse deposition of magnesium on the surface of the working electrode occurred. In other words, the magnesium deposited sparsely and thus a part where magnesium was deposited thickly and a part where deposition did not proceed existed on the surface of the working electrode, resulting in forming magnesium in a sparse state having unevenness. As a result, the film thickness of magnesium exceeded the theoretical value.

In contrast, in the case where the current density is 10 $mA/cm^2$ or more, the film thickness corresponding to the quantity of electricity was obtained. Therefore, in the case where the current density was 10 $mA/cm^2$ or more, it has been found that the density of the magnesium deposited on the surface of the working electrode was high and thus a dense and flat film of magnesium was formed.

As is clear from the test results of Tests 1, 2, and 3, magnesium alone was able to be selectively deposited when the constant potential electrolysis was performed using the electrolytic solutions in Examples 1 to 4. In addition, magnesium was able to be deposited in the form of a dense film in a uniform state. Tests 1, 2, and 3 are one embodiment of the magnesium production method in which magnesium is electrodeposited using the electrolytic solutions in this example.

The invention claimed is:

1. An electrolytic solution comprising:

magnesium chloride;

lithium chloride; and an aprotic solvent, wherein the magnesium chloride and the lithium chloride are dissolved in a total concentration of 0.16 mol or more and 0.3 mol or less, relative to 1 mol of the aprotic solvent at room temperature, the magnesium chloride is dissolved in a concentration of 0.08 mol or more and 0.2 mol or less relative to 1 mol of the aprotic solvent at room temperature, the lithium chloride is dissolved in a concentration of 0.08 mol or more and 0.2 mol or less relative to 1 mol of the aprotic solvent at room temperature, and the aprotic solvent is tetrahydrofuran.

2. The electrolytic solution according to claim 1, wherein a ratio of molar concentrations of the magnesium chloride and the lithium chloride is 1:1 to 3:1.

3. The electrolytic solution according to claim 1, wherein a case in which the magnesium chloride is not completely dissolved in the aprotic solvent, is excluded.

4. The electrolytic solution according to claim 1, wherein the room temperature is in a range of 15° C. to 25° C.

5. A magnesium production method comprising electrodepositing magnesium using the electrolytic solution according to claim 1.

6. The magnesium production method according to claim 5, wherein the magnesium is electrodeposited under a condition of a current density of 10 $mA/cm^2$ or more.

7. The magnesium production method according to claim 5, wherein the magnesium is electrodeposited at a solution temperature of the electrolytic solution set at normal temperature.

8. A magnesium production method comprising applying electroplating by immersing a workpiece in the electrolytic solution according to claim 1 and forming a plating layer on a surface of the workpiece.

9. The magnesium production method according to claim 8, wherein the electroplating is applied to the workpiece under a condition of a current density of 10 $mA/cm^2$ or more.

10. The magnesium production method according to claim 8, wherein the electroplating is applied to the workpiece at a solution temperature of the electrolytic solution set at normal temperature.

* * * * *